US008095037B2

(12) United States Patent
Onuma et al.

(10) Patent No.: US 8,095,037 B2
(45) Date of Patent: Jan. 10, 2012

(54) CORONA WIRE CARTRIDGE, CORONA DISCHARGER, AND IMAGE FORMING APPARATUS USING THE CORONA DISCHARGER

(75) Inventors: Yoshinari Onuma, Ibaraki (JP); Tsukasa Onose, Ibaraki (JP); Koji Doi, Ibaraki (JP); Hiroshi Kikuchi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 605 days.

(21) Appl. No.: 11/785,726

(22) Filed: Apr. 19, 2007

(65) Prior Publication Data

US 2007/0248379 A1 Oct. 25, 2007

(30) Foreign Application Priority Data

Apr. 21, 2006 (JP) ..... P2006-117808
Sep. 22, 2006 (JP) ..... P2006-256968
Sep. 22, 2006 (JP) ..... P2006-256969
Sep. 22, 2006 (JP) ..... P2006-256970
Feb. 22, 2007 (JP) ..... P2007-042094

(51) Int. Cl.
*G03G 21/18* (2006.01)

(52) U.S. Cl. ..... 399/115; 399/172; 250/326

(58) Field of Classification Search ..... 399/115, 399/168, 170–173; 250/324, 325; 361/235
See application file for complete search history.

(56) References Cited

U.S. PATENT DOCUMENTS 4,320,957 A * 3/1982 Brown et al. ..... 399/170
4,746,796 A 5/1988 Heigl
5,337,131 A * 8/1994 Sagiv et al. ..... 399/170
5,528,808 A * 6/1996 Holubek et al. ..... 29/227

FOREIGN PATENT DOCUMENTS

JP 62-131274 6/1987

* cited by examiner

*Primary Examiner* — David Porta
*Assistant Examiner* — Benjamin Schmitt
(74) *Attorney, Agent, or Firm* — McGinn IP Law Group, PLLC

(57) ABSTRACT

A corona wire cartridge includes: a reel around which a corona wire is wound; a reel holder that rotatably supports the reel; a casing having a receiving portion which receives the reel and the reel holder and a wire drawing opening through which the corona wire is drawn; and an elastic member that movably connects the casing to the reel holder.

19 Claims, 3 Drawing Sheets

CORONA WIRE CARTRIDGE, CORONA DISCHARGER, AND IMAGE FORMING APPARATUS USING THE CORONA DISCHARGER

BACKGROUND OF THE INVENTION

1. Field of the Invention

The present invention relates to a corona wire cartridge for a corona discharger that is applied to a charger, a transcriber, and a static eliminator of an image forming apparatus.

2. Background Art

A corona discharger where high voltage is applied to an electrode having a wire shape, a corona wire, to generate corona discharging is applied to, for example, a charger, a transcriber, and a static eliminator of a printer or a copier that forms images by using an electrography process.

In the corona wire, discharging efficiency may be reduced or local discharging may occur due to oxidation coming from the discharging or deterioration coming from attachment of floating toners resulting from static electricity during the discharging, and nonuniform charging of an object to be charged (photoreceptor, intermediate transfer body, paper, and so on) incurs poor printing including nonuniform concentration of black lines, white lines, and images.

Therefore, it is necessary to regularly replace the corona wire, and a structure where the corona wire is easily replaced is proposed in, for example, JP-A-62-131274

SUMMARY OF THE INVENTION

JP-A-62-131274 discloses a corona wire cassette where corona wires are wound around a reel member having a spiral spring therein and drawn from a casing and wound into the casing.

Even though the above-mentioned configuration provides improved handling of the corona wires, it is disadvantageous in that since parts such as switch rollers or felt rings for providing the spiral spring into the reel member or guiding the corona wires from the casing are required, costs of parts and assembling are increased.

Additionally, tension is continuously applied to the corona wires in the casing due to the spring or a transverse load is applied to the corona wires due to the switch roller, causing inferior effects such as lengthening or cutting of the corona wires.

A corona wire cartridge includes: a reel around which a corona wire is wound; a reel holder that rotatably supports the reel; a casing having a receiving portion which receives the reel and the reel holder and a wire drawing opening through which the corona wire is drawn; and an elastic member that movably connects the casing to the reel holder.

According to an aspect of the invention, it is possible to provide a corona wire cassette that has reduced costs of parts and assembling due to the small number of parts.

Furthermore, it is possible to prevent corona wires from being lengthened and cut, as an unnecessary load is not applied to the corona wires.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
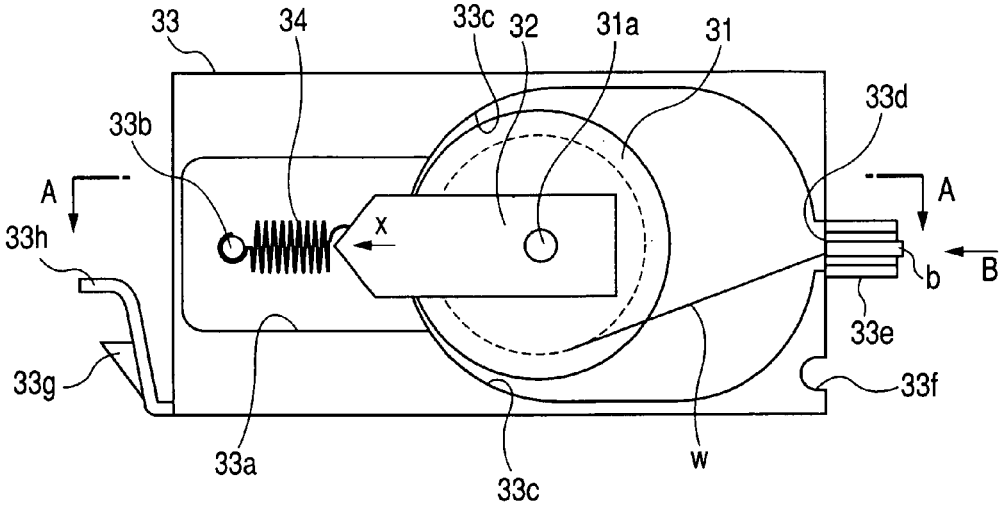
FIG. 1 is a sectional elevation view illustrating an internal configuration of a corona wire cartridge.
Figure 2:
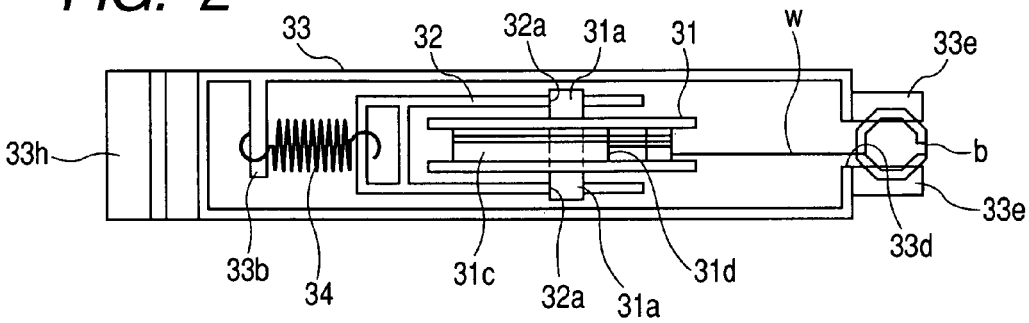
FIG. 2 is a sectional view taken in the direction of the arrow along the line A-A of FIG. 1.
Figure 3:
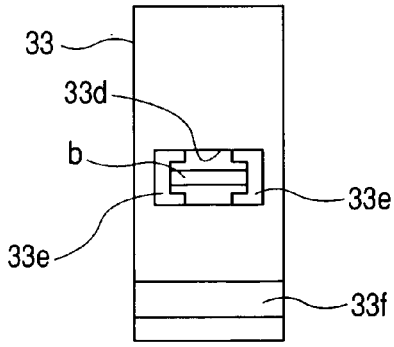
FIG. 3 is a side view taken in the direction of the arrow B of FIG. 1.
Figure 4:
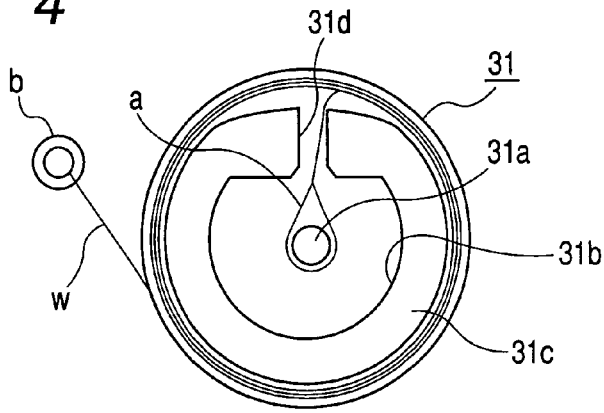
FIG. 4 is a side view of a reel.

FIG. 1 is an elevation in section illustrating an internal configuration of a corona wire cartridge, FIG. 2 is a sectional view taken in the direction of the arrow along the line A-A of FIG. 1, FIG. 3 is a side view taken in the direction of the arrow B of FIG. 1, and FIG. 4 is a side view of a reel.

In FIG. 1, reference character W denotes a corona wire that has a diameter of about 0.06 mm and is formed of a tungsten wire, and reference numeral 31 denotes a reel around which the corona wire W is wound. As shown in FIG. 4 where the reel 31 is seen in the opposite direction in relation to FIG. 1, the reel 31 has a thick portion 31*c* at a circumference thereof so that a recess 31*b* is formed around a reel shaft 31*a*.

A radial groove 31*d* extending from the recess 31*b* to the circumference of the reel 31 is formed in a portion of a thick portion 31*c*.

As to the reel 31 having the above-mentioned configuration, a wheel a that is provided at an end of the wire is hanged on the reel shaft 31*a* so that the corona wire W is supported by the reel 31. A portion other than the end of the wire W is drawn from the groove 31*d* and wound around the circumference of the reel 31. Meanwhile, an annular member b is provided at another end of the wire W.

Turning to FIG. 1, the reel 31 is supported by a reel holder 32. As shown in FIG. 2, the reel 31 is inserted into the reel holder 32 and the reel shaft 31*a* is fitted into through holes 32*a* provided in the reel holder 32, so that the reel 31 is rotatably supported by the reel holder 32.

A receiving portion 33*a* is formed in a casing 33 of the corona wire cartridge to receive the reel 31 supported by the reel holder 32, and the reel 31 and the reel holder 32 are provided in the receiving portion 33*a* like the arrangement of FIG. 1.

The connection between the reel holder 32 and the casing 33 is performed using a spring 34 extending between a protrusion 33*b* provided in the receiving portion 33*a* and the reel holder 32.

Since the reel holder 32 is always biased by the spring 34 in the direction of the arrow x, the reel 31 is also drawn in the same direction due to the reel holder 32. For this, the reel 31 is supported by inclined sides 33*c* provided in the receiving portion 33*a* to stop the drawing of the reel and to regulate the position of the reel 31 in the receiving portion 33*a*, so that excessive force (excessive tension) is not applied to the corona wire W.

A supporting portion 33*e* is provided at a wire drawing opening 33*d* of the casing 33 to support an annular member b provided at the wire W.

Figure 6:
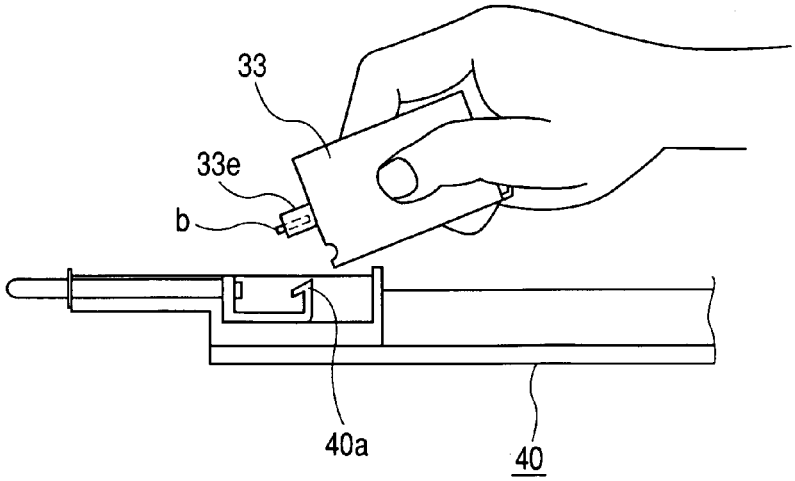
FIG. 6 is a view illustrating the provision of an end of a corona wire to a corona discharger.

As shown in FIG. 6, the annular member b which is provided at the wire W acts as a terminal hooked on a hook member 40*a* that is provided in a corona discharger 40 when the wire is provided into the corona discharger. In order to provide the wire W into the corona discharger 40, first, the annular member b is hooked on the hook member 40*a* of the corona discharger.

Figure 7:
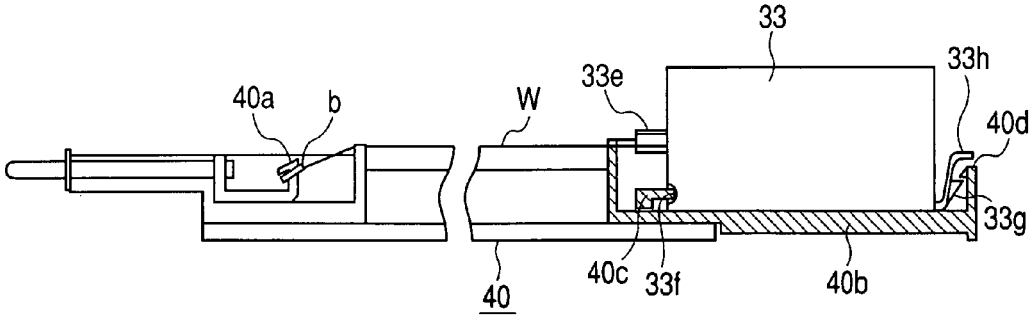
FIG. 7 is a view illustrating a device for determining a position of the corona wire cartridge in relation to the corona discharger.

Next, the cartridge longitudinally moves in relation to the corona discharger 40 to unwind the wire W. As shown in FIG. 7, the position of the cartridge that moves from an end of the corona discharger 40 to another end thereof is determined by a projection 40*c* that engages with a recess 33*f* provided on a side of the casing 33 and an engagement hook 40*d* hooked on a latch 33*g* at a cartridge mounting portion 40*b* provided in the corona discharger 40.

Since the supporting portion 33*e* which supports the annular member b is provided to the casing 33 to stabilize the posture of the annular member b, it is easy to hook the annular member b on the hook member 40*a* of the corona discharger and the replacement of the wire W is efficiently performed.

Furthermore, since a piece 33*h* having the latch 33*g* is flexible, if the cartridge is to be separated from the corona discharger, an operator pushes the piece 33*h* counterclockwise in FIG. 7 to unhook the latch 33*g* fastened with the engagement hook 40*d* of the corona discharger.

Figure 5:
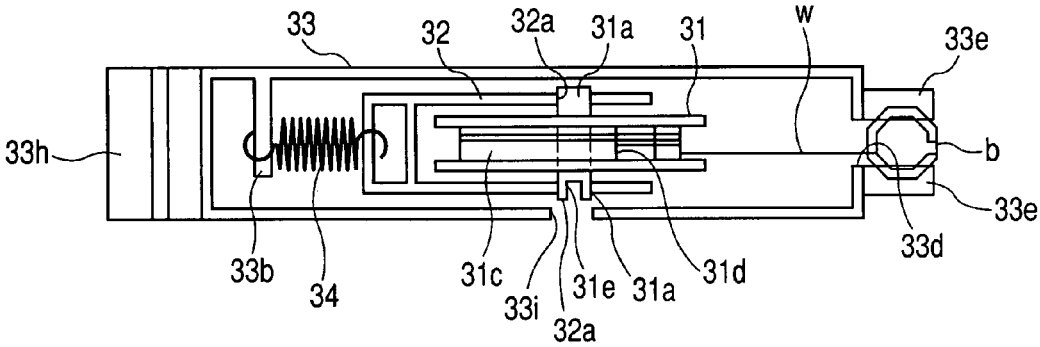
FIG. 5 is a sectional view illustrating another embodiment of the invention.

In the modification of the embodiment, as shown in FIG. 5, a through hole 33*i* may be formed in a side of the casing 33 facing the reel shaft 31*a* and a groove 31*e* for tools may be formed in the reel shaft 31*a*.

According to the above-mentioned configuration, since the winding of the wire W around the reel 31 may be performed outside, the assembling of the cartridge is efficiently performed, and, even if the wire is loosened, the wire may be tightly wound outside.

Figure 8:
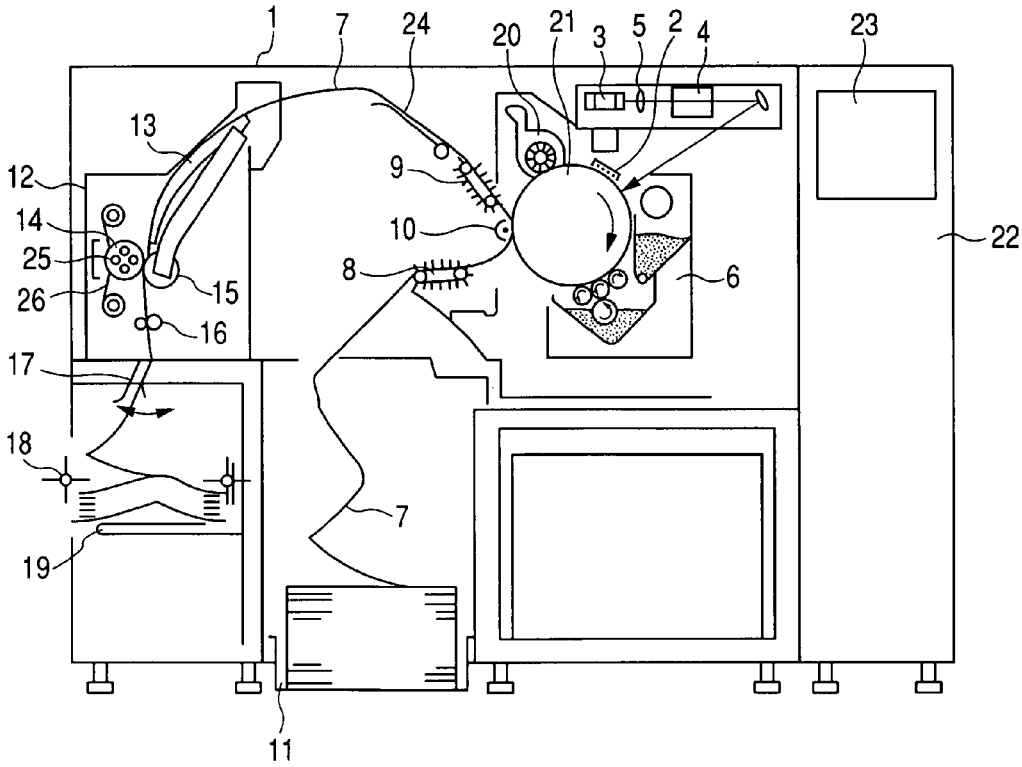
FIG. 8 is a view schematically illustrating an image forming apparatus.

FIG. 8 illustrates a laser beam printer on which a corona discharger equipped with the corona wire cartridge of the invention is mounted.

In FIG. 8, reference numeral 1 denotes a laser beam printer, and a photosensitive drum 21 starts to rotate in the direction of the arrow by printing initiation signal that is transmitted from a controller 22. The photosensitive drum 21 rotates at the speed that is identical with a printing speed of the laser beam printer 1, and continues to rotate until the printing is stopped. If the photosensitive drum 21 rotates, high voltage is applied to the corona charger 2 including the corona discharger provided with the corona wire cartridge of the invention to uniformly charge the surface of the photosensitive drum 21 so that, for example, positive charges, are uniformly formed on the surface.

A polygonal rotating mirror 3 starts to rotate immediately after power is supplied to the laser beam printer 1, and rotates highly precisely at a constant speed while the power is supplied. A laser beam emitted from a light source 4 that is formed of a semiconductor laser and so on reflects from the polygonal rotating mirror 3 and is radiated through an fθ lens 5 onto the photosensitive drum 21 while scanning is performed.

If letter data or figure data converted into dot images are transmitted from the controller 22 to the laser beam printer 1 as on/off signal of the laser beam, portions onto which the laser beam is and is not radiated are formed on the surface of the photosensitive drum 21 to form the so-called electrostatic latent image.

When the photosensitive drum having the electrostatic latent image reaches a portion facing a developing device 6, a toner is supplied to the electrostatic latent image so that the positively charged toner is absorbed by static electricity, thus forming toner images at a portion from which electric charges are removed by radiation of the laser beam onto the photosensitive drum 21.

Paper 7 that continuously extends and is received in a paper hopper 11 is transported between the photosensitive drum 21 and a transcriber 10 by using a paper transportation tractor 8 in synchronization with the arrival of the toner images of printed data formed on the upper surface of the photosensitive drum 21 to a transcription position. Furthermore, the transcriber 10 is a kind of corona discharger which is equipped with the corona wire cartridge of the invention.

The toner images formed on the photosensitive drum 21 are absorbed on the paper 7 by using the transcriber 10 that provides electric charges having the polarity opposite to that of toner images on a rear side of the paper 7.

Therefore, the paper 7 that is provided in the paper hopper 11 is transported through the paper transportation tractor 8, the transcriber 10, the paper transportation tractor 9, and a buffer plate 24 to a fixing device 12. After the paper 7 transported to the fixing device 12 is preheated by a preheating plate 13, the paper 7 is transported while being heated and pressed by using a nip portion formed by a pair of fixing rollers that is formed of a heating roller 14 provided with a heater lamp 25 and a pressing roller 15 to fix the toner images on the paper 7 by fusing.

The paper 7 which has been already transported by using the heating roller 14 and the pressing roller 15 is moved to a stacker table 19 by using a transportation roller 16 and accordion-folded along a roulette due to the swing of a swing fin 17. Furthermore, the folded paper is adjusted by using rotating paddles 18 and stacked on the stacker table 19. A portion of the photosensitive drum 21 that passes a transcription position is cleaned by using a cleaning device 20, and then waits for the next printing.

In FIG. 8, reference numeral 23 denotes a display screen that displays information regarding the state of the laser beam printer during the printing. The buffer plate 24 is used to compensate loosening or tightening of the paper 7 in the case of when there is a difference in paper transportation speed of the paper transportation tractor 9 and the fixing rollers 14 and 15. Furthermore, reference numeral 26 denotes a web member that is capable of coming into contact with the surface of the heating roller 14 and being wound and is used to clean the surface of the heating roller 14 and apply a release agent on the surface of the heating roller 14.

In the above-mentioned embodiment, a description is given of the application of the corona discharger provided with the corona wire cartridge of the invention to the charger 2 and the transcriber 10. However, a corona static electricity remover may be provided to remove static electricity from a portion of the surface of the photosensitive drum 21 between the transcriber 10 and the cleaning device 20, or a corona discharger for pre-electrification may be provided to perform pre-electrification of the surface of the photosensitive drum 21 between the cleaning device 20 and the charger 2. In this connection, the invention may be applied to the corona static electricity remover and the corona discharger for pre-electrification.

What is claimed is:

1. A corona wire cartridge comprising:

a reel around which a corona wire is wound and to which an end of the corona wire is held;

a reel holder that rotatably supports the reel;

a casing including a receiving portion which receives the reel and the reel holder and a wire drawing opening through which the corona wire is drawn; and an elastic member that movably connects the casing to the reel holder, wherein the reel holder is slidably movable in an extending direction of the corona wire, wherein the elastic member biases the reel holder in an opposite direction to a sliding direction of the reel holder so as to give a tension to the corona wire in a state where the corona wire is drawn from the casing, and wherein the receiving portion includes a curved surface formed to support the reel biased by the elastic member in a state where the corona wire is not drawn from the casing.

2. The corona wire cartridge according to claim 1, further comprising:

an annular member provided at an other end of the corona wire, wherein the wire drawing opening includes a supporting portion for supporting an annular member.

3. The corona wire cartridge according to claim 1, wherein the reel includes a rotation shaft, wherein the casing includes a side that faces the rotation shaft, the side including a through hole through which a portion of the rotation shaft is exposed, and wherein the portion of the rotation shaft includes a groove for tools.

4. The corona wire cartridge according to claim 1, wherein the reel is restrained by the curved surface of the receiving portion which is biased by the elastic member.

5. The corona wire cartridge according to claim 4, wherein the curved surface is disposed within the casing.

6. The corona wire cartridge according to claim 1, wherein, in a state in which an other end of the corona wire is free, the reel exerts other than a tension force on a portion of the corona wire which is unrolled from the reel.

7. The corona wire cartridge according to claim 1, wherein a distal end of the corona wire is disposed at the reel.

8. The corona wire cartridge according to claim 1, wherein the elastic member is located between the pair of walls of the casing.

9. The corona wire cartridge according to claim 1, wherein the end of the corona wire is accommodated in the casing.

10. The corona wire cartridge according to claim 1, wherein the curved surface and the casing comprise a same member.

11. The corona wire cartridge according to claim 1, wherein the curved surface comprises an edge of a cutout section of the casing.

12. A corona discharger comprising:

a corona wire cartridge, the corona wire cartridge including:

a reel around which a corona wire is wound and to which an end of the corona wire is held;

a reel holder that rotatably supports the reel;

a casing including a receiving portion which receives the reel and the reel holder and a wire drawing opening through which the corona wire is drawn, the receiving portion, reel and reel holder being located between a pair of walls of the casing which are disposed perpendicular to an axis about which the reel rotates; and an elastic member that movably connects the casing to the reel holder.

wherein the reel holder is slidably movable in an extending direction of the corona wire, wherein the elastic member biases the reel holder in an opposite direction to a sliding direction of the reel holder so as to give a tension to the corona wire in a state where the corona wire is drawn from the casing, and wherein the receiving portion includes a curved surface formed to support the reel biased by the elastic member in a state where the corona wire is not drawn from the casing.

13. The corona discharger according to claim 12, wherein the corona wire cartridge is detachable from the corona discharger.

14. The corona discharger according to claim 12, wherein the elastic member is located between the pair of walls of the casing.

15. The corona discharger according to claim 12, wherein the end of the corona wire is accommodated in the casing.

16. An image forming apparatus comprising:

a corona discharger including a corona wire cartridge, the corona wire cartridge including:

a reel around which a corona wire is wound and to which an end of the corona wire is held;

a reel holder that rotatably supports the reel;

a casing including a receiving portion which receives the reel and the reel holder and a wire drawing opening through which the corona wire is drawn, the receiving portion, reel and reel holder being located between a pair of walls of the casing which are disposed perpendicular to an axis about which the reel rotates; and an elastic member that movably connects the casing to the reel holder, wherein the reel holder is slidably movable in an extending direction of the corona wire, wherein the elastic member biases the reel holder in an opposite direction to a sliding direction of the reel holder so as to give a tension to the corona wire in a state where the corona wire is drawn from the casing, and wherein the receiving portion includes a curved surface formed to support the reel biased by the elastic member in a state where the corona wire is not drawn from the casing.

17. The image forming apparatus according to claim 16, wherein the corona wire cartridge is detachable from the corona discharger.

18. The image forming apparatus according to claim 16, wherein the elastic member is located between the pair of walls of the casing.

19. The image forming apparatus according to claim 16, wherein the end of the corona wire is accommodated in the casing.

* * * * *